US006779330B1

(12) United States Patent
Andrews et al.

(10) Patent No.: US 6,779,330 B1
(45) Date of Patent: Aug. 24, 2004

(54) ANTIMICROBIAL CUT-RESISTANT COMPOSITE YARN AND GARMENTS KNITTED OR WOVEN THEREFROM

(75) Inventors: Dean Riley Andrews, Concord, NC (US); Gregory V. Andrews, Concord, NC (US); John D. Simmons, Rockwell, NC (US)

(73) Assignee: World Fibers, Inc., Concord, NC (US)

( * ) Notice: Subject to any disclaimer, the term of this patent is extended or adjusted under 35 U.S.C. 154(b) by 120 days.

(21) Appl. No.: 09/702,619

(22) Filed: Oct. 31, 2000

(51) Int. Cl.[7] ..... D02G 3/02

(52) U.S. Cl. ..... 57/210; 2/2.5; 2/16; 2/21; 2/159; 2/161.6; 2/907; 57/211; 57/217; 57/218; 57/220; 57/232; 57/233; 57/258; 66/174; 428/195; 428/357; 428/364; 428/365; 428/368; 428/370; 428/377; 428/378; 428/911; 442/134; 442/190; 442/191; 442/197; 442/228; 442/229; 442/308; 442/310; 442/316; 442/317

(58) Field of Search ..... 2/2.5, 16, 21, 159, 2/161.6, 907; 57/210, 211, 212, 213, 217, 218, 220, 221, 222, 223, 230, 232, 233, 243, 244, 250, 258; 66/174; 428/195, 357, 364, 365, 368, 370, 377, 378, 911; 442/134, 190, 191, 197, 228, 229, 308, 310, 316, 317

(56) References Cited

U.S. PATENT DOCUMENTS

| | | | |
|---|---|---|---|
| 429,005 | A | 5/1890 | Bird |
| 831,108 | A | 9/1906 | Ryder |
| 1,275,469 | A | 8/1918 | Pruessman |
| 1,574,004 | A | 2/1926 | Ryder |
| 1,860,030 | A | 5/1932 | Hinchliff |
| 1,947,302 | A | 2/1934 | Meiwald |
| RE19,551 | E | 4/1935 | Meiwald |
| 2,006,275 | A | 6/1935 | Meiwald |
| 2,137,692 | A | 11/1938 | Linke |
| 2,165,296 | A | 7/1939 | Oass |
| 2,250,863 | A | 7/1941 | Goodloe |
| 2,335,644 | A | 11/1943 | Camp |
| 3,277,564 | A | 10/1966 | Webber et al. |
| 3,288,175 | A | 11/1966 | Valko |
| 3,490,224 | A | 1/1970 | Bourgeas |
| 3,572,397 | A | 3/1971 | Austin |
| 3,607,822 | A | 9/1971 | Nishino |

(List continued on next page.)

FOREIGN PATENT DOCUMENTS

| | | |
|---|---|---|
| DE | 315038 | 10/1919 |
| DE | 1 610 495 | 1/1971 |
| EP | 0 458 343 A1 | 11/1991 |
| EP | 0 498 216 A1 | 8/1992 |
| FR | 718029 | 1/1932 |
| FR | 20358B/11 | 6/1977 |
| GB | 187327 | 10/1922 |
| GB | 2 018 323 A | 10/1979 |
| JP | 02706B/02 | 4/1977 |
| JP | 89-252424/35 | 1/1988 |

OTHER PUBLICATIONS

Sodemetex Publication; Avantages du procëdë; Entire brochure; Published prior to Oct. 31, 2000.

*Primary Examiner*—Arti R. Singh
(74) *Attorney, Agent, or Firm*—Adams Evans P.A.

(57) ABSTRACT

An antimicrobial, cut-resistant composite yarn which has a core member including at least one cut-resistant strand, a cover member including at least one strand wrapped around and enclosing the core member, wherein at least one strand in either the core member or the cover member is treated with and incorporates an antimicrobial compound. The yarn can be used to fabricate cut-resistant garments, such as gloves, worn by meat cutters and others who work with knives, saws and other sharp implements. The antimicrobial effect reduces bacteria, mold and fungi growth on the garments between washings.

16 Claims, 3 Drawing Sheets

U.S. PATENT DOCUMENTS 3,699,590 A 10/1972 Webber et al.
3,700,515 A 10/1972 Terry
3,821,067 A 6/1974 Taylor et al.
3,883,898 A 5/1975 Byrnes, Sr.
3,889,035 A 6/1975 Jakes
3,895,149 A 7/1975 Sheffler et al.
3,923,926 A 12/1975 Harada et al.
3,953,893 A 5/1976 Byrnes, Sr.
4,004,295 A 1/1977 Byrnes, Sr.
4,106,276 A 8/1978 Hosoya
4,202,382 A 5/1980 Westhead
4,267,044 A 5/1981 Kroplinski et al.
4,272,950 A 6/1981 Bompard
4,299,884 A 11/1981 Payen
4,384,449 A 5/1983 Byrnes, Sr. et al.
4,470,251 A * 9/1984 Bettcher ..... 57/230
4,523,425 A 6/1985 Schild et al.
4,534,262 A 8/1985 Swenson
4,640,950 A 2/1987 Nishino et al.
4,651,514 A 3/1987 Collett
4,777,789 A 10/1988 Kolmes et al.
4,818,587 A 4/1989 Ejima et al.
4,838,017 A 6/1989 Kolmes et al.
4,886,691 A 12/1989 Winckihofre
4,912,781 A 4/1990 Robins et al.
4,936,085 A 6/1990 Kolmes et al.
5,010,723 A 4/1991 Wilen
5,070,540 A 12/1991 Bettcher et al.
5,119,512 A 6/1992 Dunbar et al.
5,177,948 A 1/1993 Kolmes et al.
5,248,548 A 9/1993 Toon
5,287,690 A 2/1994 Toon
5,296,238 A * 3/1994 Sugiura et al. ..... 424/604
5,423,168 A 6/1995 Kolmes et al.
5,442,815 A 8/1995 Cordove et al.
5,568,657 A 10/1996 Cordova et al.
5,597,649 A 1/1997 Sandor et al.
5,628,172 A 5/1997 Kolmes et al.
5,632,137 A 5/1997 Kolmes et al.
5,655,358 A 8/1997 Kolmes
5,806,295 A 9/1998 Robins et al.
5,822,791 A * 10/1998 Baris ..... 2/2.5
5,845,476 A 12/1998 Kolmes
5,851,668 A 12/1998 Sandor et al.
5,965,223 A * 10/1999 Andrews et al. ..... 428/34.5
6,016,648 A 1/2000 Bettcher et al.
6,155,084 A * 12/2000 Andrews et al. ..... 66/174
6,260,344 B1 * 7/2001 Chakravarti ..... 57/230
6,266,951 B1 * 7/2001 Chakravarti ..... 57/210
6,351,932 B1 * 3/2002 Hummel ..... 57/210

* cited by examiner

ANTIMICROBIAL CUT-RESISTANT COMPOSITE YARN AND GARMENTS KNITTED OR WOVEN THEREFROM

TECHNICAL FIELD AND BACKGROUND OF THE INVENTION

This invention relates to cut-resistant yarns, particularly composite cut resistant yarns which have been treated to retard the growth of microbes which can cause food contamination and illness in humans and to garments such as cut-resistant gloves knitted or woven from such yarns. In accordance with the invention, yarns treated to retard the growth of microbes, such as bacteria, molds and fungi are knitted or woven into gloves of the type worn by meat cutters and others whose job involves working with knives, saws and other sharp objects.

Certain types of medical gloves treated with antimicrobial agents are known, as are cut-resistant gloves which achieve a measure of antimicrobial protection through the plating of a treated acetate fiber to a cut-resistant yarn as a part of the knitting process. However, applicants are not aware of a cut-resistant composite yarn which itself contains an antimicrobial component.

Users needing protection against cuts and also requiring a high level of dexterity now have a variety of products available for use. Some such products, for example, gloves knitted from fibers such as those sold under the name KEVLAR and ultrahigh molecular weight polyolefin fibers such as those sold under the name SPECTRA, provide a moderate degree of safety and protection but are extremely costly. Commercial examples of these engineered fibers include those sold by Honeywell, Inc. under the names SPECTRA 900 and SPECTRA 1000, and by the DuPont company of Wilimington, Del. under the name KEVLAR.

Less expensive yarns have been developed from various combinations of wire, fiberglass, polyester, polypropylene and polyolefin fibers which are nevertheless more cut-resistant. Several, embodiments are disclosed in the following patents:

| U.S. PAT. NO. | ISSUE DATE | INVENTOR | TITLE |
|---|---|---|---|
| 4,383,449 | May 23, 1983 | Byrne, Sr. | PROTECTIVE GLOVES AND THE LIKE AND A YARN WITH FLEXIBLE CORE WRAPPED WITH ARAMID FIBER |
| 4,651,514 | Mar. 24, 1987 | Collett | ELECTRICALLY NONCONDUCTIVE, ABRASION AND CUT RESISTANT YARN |
| 4,777,789 | Oct. 18, 1988 | Kolmes et al. | WIRE WRAPPED YARN FOR PROTECTIVE GARMENTS |
| 4,818,587 | Apr. 04, 1989 | Ejima et al. | NONWOVEN FABRICS AND METHOD FOR PRODUCING THEM |
| 4,838,017 | Jun. 13, 1989 | Kolmes et al. | WIRE WRAPPED YARN FOR PROTECTIVE GARMENTS |
| 4,886,691 | Dec. 12, 1989 | Wincklhofer | CUT RESISTANT JACKET FOR ROPES, WEBBING, STRAPS, INFLATABLES AND THE LIKE |

-continued

| U.S. PAT. NO. | ISSUE DATE | INVENTOR | TITLE |
|---|---|---|---|
| 4,936,085 | Jun. 26, 1990 | Kolmes et al. | YARN AND GLOVE |
| 5,010,723 | Apr. 30, 1991 | Wilen | TWISTED YARN WHICH WILL MAINTAIN ITS TWIST AND PRODUCTS PRODUCED THEREFROM |
| 5,119,512 | Jun. 9, 1992 | Dunbar et al. | CUT RESISTANT YARN, FABRIC AND GLOVES |
| 5,177,948 | Jan. 12, 1993 | Kolmes et al. | YARN AND GLOVE |

U.S. Pat. No. 4,384,449 shows protective gloves and the like and a yarn comprising a core of a flexible wire alongside an aramid fiber strand or strands and a covering of aramid fiber such as that manufactured and sold under the name KEVLAR by the DuPont company of Wilmington, Del. in which the aramid fiber is either spun or filament. Two aramid fiber strands, either spun or filament, are wrapped around the core with one strand wrapped in a clockwise direction and the other strand wrapped in a counter-clockwise direction with the opposite spiral wrapping of the strands serving to secure the strands in position on the core without any other securing means. The yarn having a flexible core with aramid fiber strands wrapped thereon is used to make protective gloves on conventional glove knitting or weaving machinery and is capable of movement in relation to needle eyes and the like without jamming in the same manner as various natural and synthetic fiber yarns. The yarn having a flexible core with aramid fiber strands wrapped thereon is also used in making various U.S. other products normally made of conventional fiber yarn.

U.S. Pat. No. 4,651,514 shows an electrically non-conductive, cut and abrasion resistant yarn for use in the manufacture of protective coverings including a core of monofilament nylon having a diameter in the range of about 0.004 to 0.020 inches, a first wrap on the core of at least one strand of aramid fiber having a cotton count size in the range of about 1/1 to 30/1 and a second wrap on the core of texturized nylon of two to eight ply construction. Each ply is made up. of 24 to 44 nylon filaments with each filament being about 50–90 denier.

U.S. Pat. No. 4,777,789 shows an improved yarn, fabric and protective garment made from such yarn where the yarn, fabric and garment exhibit increased cut resistance. The yarn includes a cord made of fiber and a covering wrapped around the core, the covering includes at least one strand of wire wrapped around the core.

U.S. Pat. No. 4,818,587 shows nonwoven fabrics contain at least 30% by weight of heat-adhesive composite fibers consisting of core portion and sheath portion, the core portion being of the side-by-side type composite structure comprising two core components of different polypropylene base polymers in a composite ratio of 1:2 to 2:1, one of the core components having a Q value, expressed in terms of the weight-average molecular weight/the number-average molecular weight, equal to or higher than 6 and the other having a Q value equal to or lower than 5, and the sheath portion meeting at least the requirement that it should comprise a sheath component of a polyethylene base polymer having a melting point lower by at least 20° C. than the lower one of the melting points of the two core components. The nonwoven fabrics are bulky and soft due to the crimps of the heat-adhesive composite fibers resultant form the core portion and are stabilized by the interfiber bonds of the sheath portion.

U.S. Pat. No. 4,838,017 shows an improved yarn, fabric and protective garment made from such yarn where the yarn, fabric and garment exhibit increased cut resistance. The yarn includes a core made of fiber and a covering wrapped around the core, the covering includes at least one strand of wire wrapped around the core.

U.S. Pat. No. 4,886,691 shows a cut resistant article comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber.

U.S. Pat. No. 4,936,085 shows an improved yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands is fiberglass, the non-fiberglass strands are preferably nylon or polyester.

U.S. Pat. No. 5,010,723 shows a yarn produced from two or more twisted cellulosic fibers, such as cotton or cotton rayon fibers, the plies being helically wound around a thermoplastic filament core which is subsequently melted to bind the inner portions of the yarn together so that it does not untwist or shed lint readily. The yarn is employed in a dust mop or floor mat for a shampoos, bonnet for stain resistant treated carpet.

U.S. Pat. No. 5,119,512 shows a cut resistant article 20 comprising a cut resistant jacket surrounding a less cut resistant member. The jacket comprises a fabric of yarn and the yarn consists essentially of a high strength, longitudinal strand having a tensile strength of at least 1 GPa. The, strand is wrapped with another fiber or the same fiber. In another embodiment, the invention is a highly cut resistant yarn of at least two nonmetallic fibers. One fiber is inherently cut resistant like high strength polyethylene, polypropylene or aramids. The other fiber in the yarn has a high level of hardness.

U.S. Pat. No. 5,177,948 shows an improved non-metallic yarn, 30 fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands of the core is fiberglass, the non-fiberglass strands are preferably nylon, extended chain polyethylene, aramid or polyester.

Any of these structures can be treated in accordance with the invention of this application in order to provide antimicrobial effects to the yarn and the garment fabricated from the yarn. These yarns are generally sufficiently heat-resistant to permit periodic sterilization to kill bacteria and other microbes. Yarns treated as described in this application provide greatly retarded microbe development between sterilization treatments, thereby greatly reducing the possibility of contamination of food products.

SUMMARY OF THE INVENTION

Therefore, it is an object of the invention to provide a cut-resistant composite yarn which has been treated to provide antimicrobial effects.

It is another object of the invention to provide a cut-resistant composite yarn which has at least one carrier yarn which has been treated to provide antimicrobial effects.

It is another object of the invention to provide a cut-resistant composite yarn which is sufficiently flexible and resilient to be woven or knitted into a garments having antimicrobial effects.

The present invention provides significant protection both against cuts to the user but also retards growth of microbes which can contaminate food products being processed or handled by the user.

Typically, the core material is a strand of fiberglass. In order to minimize the mount of fiberglass fragments that break free from the fiberglass strand and irritate the skin of the person coming in contact with the fiberglass fragments, a series of covering wraps are employed. These covering wraps may also be a highly cut resistant material in and of themselves. In addition, the outer wrap may be a fiber that is smooth to the touch such as polyester or nylon. However, in order to maximize cut resistance, the covering wraps may be selected from the group consisting of polyolefins such as that sold under the name SPECTRA or aramids such as that sold under the name KEVLAR.

Preferably, the cover members are wrapped, wound or twisted around the core in a manner which permits successive layers to be wrapped, wound or twisted around the core in an opposite direction from the cover element immediately below.

The resulting protective yarns are then suitable for knitting into protective gloves and other protective garments. These yarns offer an inexpensive alternative to existing protective yarns while providing substantial cut protection without irritating a user's skin.

Winding the cover layers on the fiberglass core so that an adjacent cover layer is wound in a direction opposite to the layer immediately beneath it gives the protective yarn the desired characteristics at a much lower cost than existing yarns. The invented protective yarn is flexible enough that it can be knitted into a protective fabric or garment on conventional knitting or weaving-machines and yet is strong enough to offer substantial cut resistance. Finally, the invented protective, yarn resists shrinkage which results from exposure to extremely high temperatures during the washing process.

These and other objects of the present invention are achieved in the preferred embodiments disclosed below by providing an antimicrobial, cut-resistant composite yarn, comprising a core member including at least one cut-resistant strand, a cover member including at least one strand wrapped around and enclosing the core member, wherein at least one strand in either the core member or the cover member is treated with and incorporates an antimicrobial compound.

According to one preferred embodiment of the invention, the core member comprises a cut-resistant strand and a synthetic core yarn, wherein the synthetic core yarn is treated with and incorporates the antimicrobial compound.

According to another preferred embodiment of the invention, the cover member comprises at least two oppositely-wrapped synthetic cover yarns, wherein at least one of the synthetic cover yarns is treated with and incorporates the antimicrobial compound.

According to yet another preferred embodiment of the invention, the synthetic core yarn and the synthetic cover yarns are selected from the group consisting of polyester, polyethylene, polypropylene, nylon and acetate.

According to yet another preferred embodiment of the invention, an antimicrobial, cut-resistant composite yarn is provided, comprising a core member including at least one cut-resistant strand and at least one synthetic yarn residing in substantially parallel relation to each other, a cover member including at least two synthetic yarns wrapped in opposite directions around and enclosing the core member, wherein at least one yarn in either the core member or the cover member is treated with and incorporates an antimicrobial compound.

According to yet another preferred embodiment of the invention, the cut-resistant strand is selected from the group consisting of fiberglass, metal wire, aramid and polyolefin fiber.

According to yet another preferred embodiment of the invention, the cover member comprises three yarns wrapped in alternate directions around the core member.

According to yet another preferred embodiment of the invention, the cut-resistant composite yarn including a core wrapper strand wrapped around the core member between the core member and the cover member.

According to yet another preferred embodiment of the invention, the core wrapper strand is chosen from the group consisting of fiberglass, metal wire, aramid and polyolefin fiber.

According to yet another preferred embodiment of the invention, an antimicrobial, cut-resistant composite yarn is provided, comprising a core member including a cut-resistant strand and a synthetic yarn residing in substantially parallel relation to each other, a core wrapper strand wrapped around the core member, and comprising a strand chosen from the group consisting of fiberglass, metal wire, aramid and polyolefin fiber, a cover member including three synthetic yarns wrapped in alternating directions around and enclosing the core member, wherein at least one yarn in the cover member is treated with and incorporates an antimicrobial compound.

According to yet another preferred embodiment of the invention, a cut-resistant garment is provided which is fabricated from an antimicrobial, cut-resistant composite yarn according to the invention.

According to yet another preferred embodiment of the invention, the garment comprises a glove.

According to yet another preferred embodiment of the invention, the glove is fabricated by knitting.

In one preferred embodiment of the present invention, a protective yarn has a single fiberglass core fiber and one or more cover members. The cover members are selected from the group consisting of aramid fiber, ultrahigh molecular weight polyolefin fiber, polyester, nylon and polyacrylic fibers. The cover members are wrapped, wound or twisted around the core in a manner which permits successive layers to be wrapped, wound or twisted around the core in an direction opposite that of the cover member immediately below.

By using only one fiberglass core instead of multiple non-glass fiber cores, the present invention provides cut resistance equal to or greater than that obtained by using purely engineered cut resistant fibers such as those sold under the names SPECTRA and a KEVLAR at a significantly lower cost. Substituting a lower strength hard and brittle fiber material such as fiberglass to the core of the yarn adds a significant level of cut resistance at a fraction of the cost. The addition of new yarn components has substantially reduced a user's manual dexterity problems and increased the protection against cuts to the protected body member.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

In general, the invention comprises a cut-resistant yarn which has at least two fiber components, one of which is a core yarn and one of which is a cover yarn. Either or both of the core yarn and cover yarn may themselves be comprised of two or more yarns oriented together in a predetermined, conventional manner. One of the component yarns serves as a carrier yarn for an antimicrobial agent. The carrier yarn may be part of the core or part of the cover. The resulting yarn achieves cut resistance at Level 2 or above as defined and determined by the Cut Protection Performance Test (ANSI/ISEA standard 105-2000).

Figure 1:
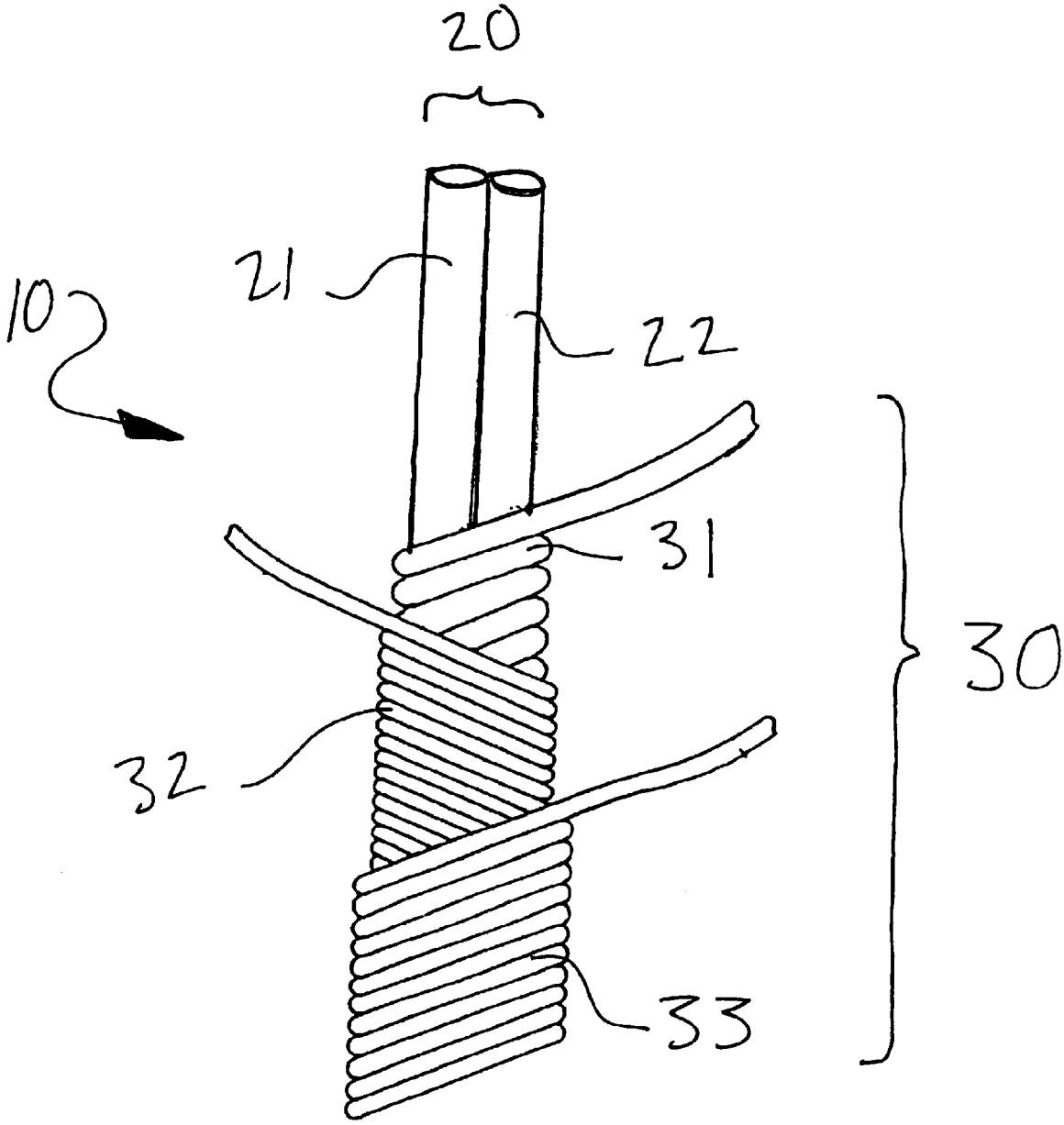
FIG. 1 is a schematic view of one yarn construction which can be treated, with an antimicrobial agent in accordance with the invention.

Referring now specifically to the drawings, a protective yarn according to the present invention is illustrated in FIG. 1 and shown generally at reference numeral 10. The protective yarn 10 is a composite which includes a core member 20 and a cover member 30. The core member 20 includes a strand of fiberglass 21 and a strand of polypropylene 22. As shown in FIG. 1, the cover member 30 is preferably comprised of three helically-wrapped cover yarns—an inner cover yarn 31, wrapped, wound or twisted on the core member 20, a middle cover yarn 32 wrapped, wound or twisted on the inner cover yarn 31 such that the orientation of the middle cover helix is opposite that of the inner cover yarn 31, and a outer cover yarn 33 wrapped, wound or twisted on the middle cover 32 such that the orientation of the outer cover helix is opposite that of the middle cover yarn 32.

The fiberglass strand 21 is preferably a single longitudinal strand of G75 fiberglass, and the polypropylene strand 22 is preferably a single parallel strand of 150 denier polypropylene treated with an organic antimicrobial compound such as products sold under the names TRICLOSAN, (manufactured by Ciba-Geigy) and MICROBAN (manufactured by Microban, Inc.). Alternative yarns which may be treated include but are not limited to polyester acetate and nylon.

The fiberglass strand 21 and polypropylene strand 22 are preferably not twisted together, but lie essentially parallel to each other.

The inner cover yarn 31 is a 375 denier yarn, an extended chain polyolefin sold under the name T1000 SPECTRA. The middle cover yarn 32 is also a 375 denier yarn sold under the name T1000 SPECTRA. The outer cover yarn is a 500 denier flat polyester yarn.

The number of turns per inch that the cover members 30 are wound around the core 20 varies according to the cover layer and cover material. In FIG. 1, the inner cover 31 is wound on the core member 20 at approximately 4.8 turns per inch. The middle cover yarn 32 is wound on the inner cover yarn 31 at approximately 9.1 turns per inch. The outer cover yarn 33 is wrapped on the middle cover yarn 32 at approximately 8.2 turns per inch.

The antimicrobially treated polypropylene strand 22 according to a preferred embodiment of the invention is treated with an antimicrobial compound sold under the name TRICLOSAN at a rate of one percent by weight.

This concentration is sufficient to kill, in a glove fabricated from the yarn 10, 99.9 percent of the test organisms according to test method EPA-TM-002 (Dow Shaker Assay). The test organisms are *Escherichia coli, Salmonella choleraesuis* and *Klebsiella pneumonia.*

Figure 2:
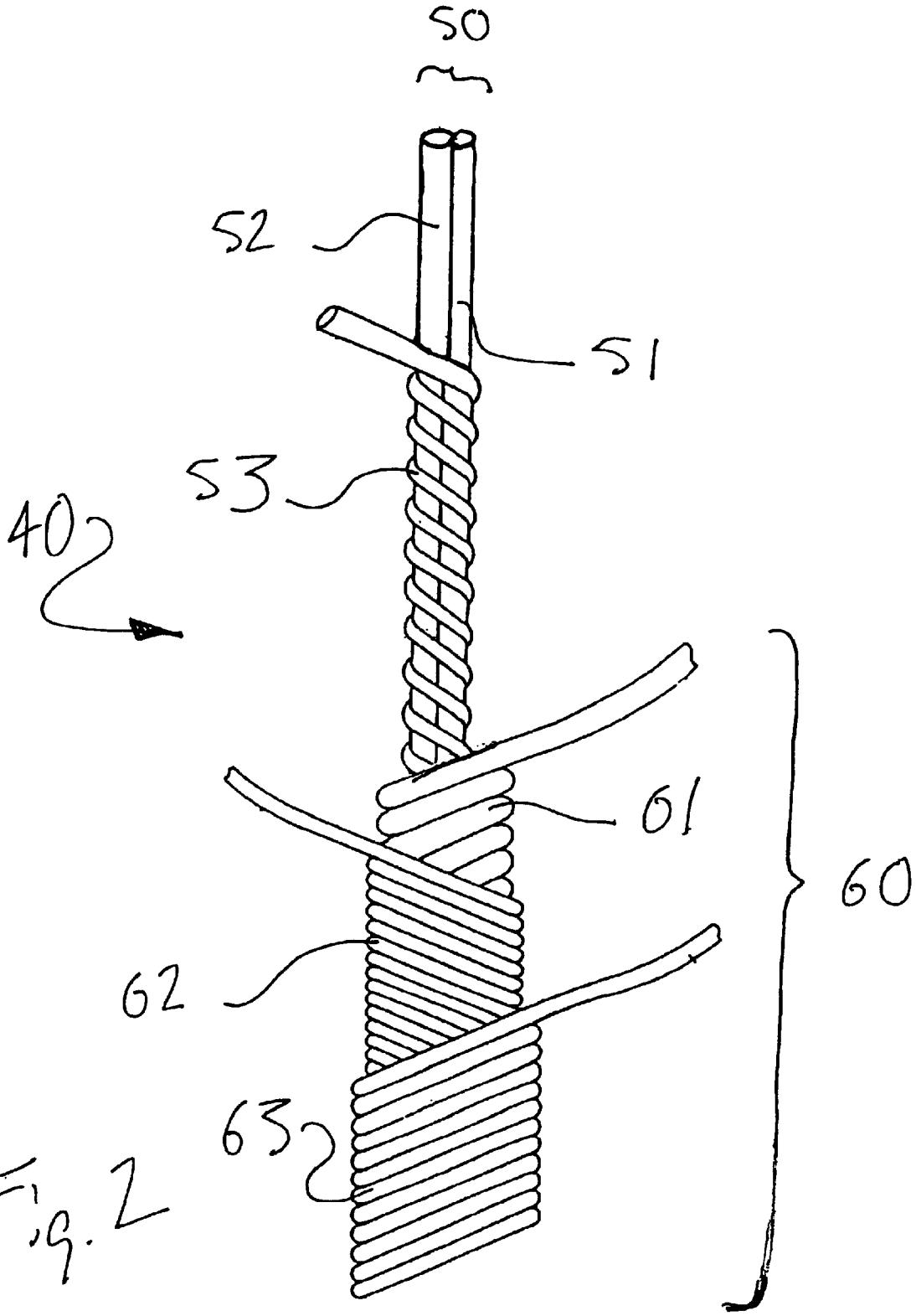
FIG. 2 is a schematic view of another yarn construction which can be treated with an antimicrobial agent in accordance with the invention.
Figure 3:
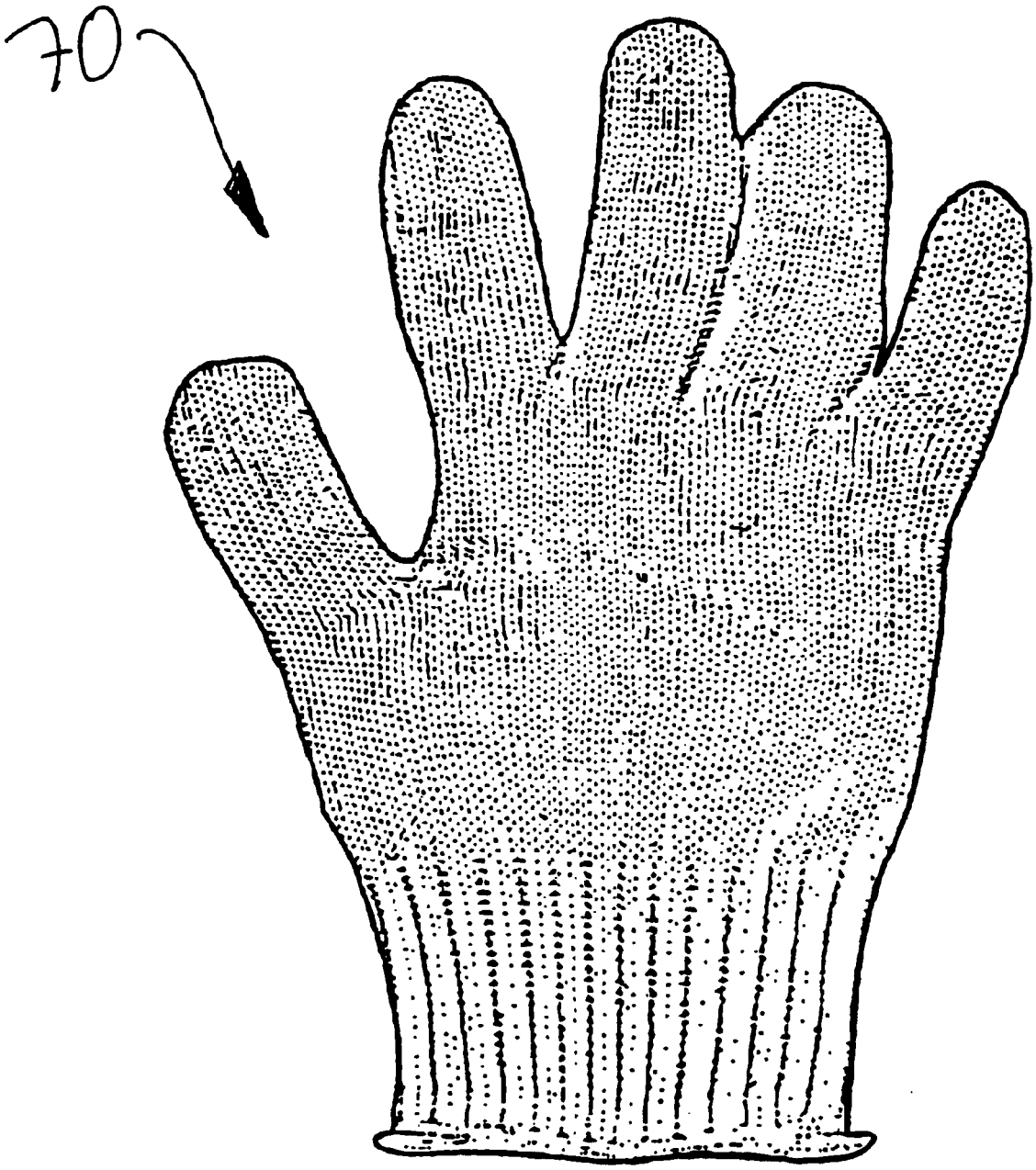
FIG. 3 is a view of a glove of the type fabricated from a yarn according to the yarns of FIGS. 1–2.

A second embodiment of the present invention is shown in FIG. 2. A protective yarn, generally referred to at reference numeral 40, includes a core member 50 and a cover member 60. The core member 50 includes a strand of stainless steel wire 51, a strand of polyester 52, and a core wrap 53. As shown in FIG. 2, the cover member 60 is preferably comprised: of three helically-wrapped cover yarns—an inner cover yarn 61, wrapped, wound or twisted on the core member 50, a middle cover yarn 62 wrapped, wound or twisted on the inner cover yarn 61 such that the orientation of the middle cover helix is opposite that of the inner cover yarn 61, and an outer cover yarn 63 wrapped, wound or twisted on the middle cover 62 such that the orientation of the outer cover helix is opposite that of the middle cover yarn 62.

The wire strand 51 is preferably a single longitudinal strand of stainless steel with a diameter of 0.003 in. The polyester strand 52 is preferably a single parallel strand of 500 denier flat polyester yarn.

The wire strand 51 and polyester strand 52 are preferably not twisted together, but lie essentially parallel to each other. The core wrap 53 is preferably a 0.002 in. diameter stainless steel wire.

The inner cover yarn 61 is 150 denier polyester. The middle cover yarn 62 and the outer cover yarn 63 are each preferably a 500 denier flat polyester yarn.

The number of turns per inch with which the cover yarns 61, 62, 63 are wound around the core member 50 varies according to the cover layer and cover material. In FIG. 2, the inner cover is wound on the core member 50 at approximately 4.8 turns per inch. The middle cover yarn 62 is wound on the inner cover yarn 61 at approximately 9.1 turns per inch. The outer cover yarn 63 is wrapped on the middle cover yarn 62 at approximately 8.2 turns per inch.

The inner cover yarn 61 according to a preferred embodiment of the invention is treated with an inorganic antimicrobial silver-based compound manufactured by Healthshield Technologies and sold under the name AGION. The compound is applied at a rate of one percent by weight. An alternative inorganic antimicrobial compound suitable for use is a silver and zinc oxide-based compound sold under the name MICROFREE and made by Du Pont Specialty Chemicals.

Other constructions are possible, including yarns having single and multi-strand cores with single or multi-strand covers, with one or more of the core strands and/or cover strands treated with either an organic or inorganic antimicrobial compound of the types described above. In general, these antimicrobial agents can be used to treat a wide range of synthetic fiber yarns, including polyester, nylon, polyethylene, polypropylene and acetate. A cut-resistant glove of the type worn by meat cutters is shown in FIG. 5 at reference numeral 70.

A composite cut-resistant yarn with antimicrobial characteristics and a garment constructed from such a yarn are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. An antimicrobial, cut-resistant composite yarn, comprising:

(a) a core member including a cut resistant strand;

(b) a first cover member including at least one extended chain polyolefin fiber strand wrapped around the core member; and (c) a second cover member treated with and incorporating an antimicrobial compound.

2. An antimicrobial yarn according to claim 1, wherein said second cover member comprises a polyester fiber.

3. An antimicrobial yarn according to claim 1, wherein said cut resistant strand comprises fiberglass.

4. An antimicrobial yarn according to claim 1, wherein said second cover member comprises one or more fiber strands selected from the group consisting of polyester, polyethylene, polypropylene, nylon and acetate.

5. An antimicrobial yarn according to claim 1, wherein said extended chain polyolefin strand fiber strand has a denier of about 375.

6. An antimicrobial yarn according to claim 1, wherein said second cover member comprises a 500 denier flat polyester yarn.

7. An antimicrobial yarn according to calm 1, further comprising a third cover member wrapped around said second cover member, said first cover member and said core member.

8. An antimicrobial yarn according to claim 7, wherein said third cover member comprises one or more fiber strands selected from the group consisting of extended chain polyolefin and polyester.

9. An antimicrobial, cut-resistant composite yarn, comprising:

(a) a core member including a fiberglass strand and a polypropylene strand residing in substantially parallel relation to each other;

(b) a cover member including at least one extended chain polyolefin fiber strand wrapped around the core member;

(c) wherein said polypropylene strand is treated with and incorporates an antimicrobial compound.

10. An antimicrobial yarn according to claim 9, wherein said cover member comprises three yarns wrapped in alternate directions around the core member.

11. An antimicrobial yarn according to claim 9, and including a core wrapper strand wrapped around the core member between tho core member and the cover member.

12. An antimicrobial yarn according to claim 11, wherein said core wrapper strand is chosen from the group consisting of fiberglass, metal wire, aramid and polyolefin fiber.

13. An antimicrobial, cut-resistant composite yarn, comprising:

(a) a core member including a fiberglass strand and a polypropylene strand residing in substantially parallel relation to each other;

(b) a first extended chain polyolefin fiber strand wrapped around the core member;

(c) a second extended chain polyolefin fiber strand wrapped in an alternate direction around the first extended chain polyolefin strand and the core member;

(d) a polyester strand wrapped in an alternate direction around the first and second extended chain polyolefin fiber strands and the core member; and (e) wherein said polypropylene strand is treated with and incorporates an antimicrobial compound.

14. A cut-resistant garment fabricated from an antimicrobial, cut-resistant composite yarn according to claim 1, 2, 3, 4, 9, 10, 11, 12, or 13.

15. A cut-resistant garment according to claim 14, wherein said garment comprises a glove.

16. A cut-resistant garment according to claim 15, wherein said glove is fabricated by knitting.

* * * * *